US011401950B2

(12) United States Patent
Schreckenberg

(10) Patent No.: US 11,401,950 B2
(45) Date of Patent: Aug. 2, 2022

(54) PUMP HOUSING HAVING A FASTENING STRUCTURE

(71) Applicant: PIERBURG PUMP TECHNOLOGY GMBH, Neuss (DE)

(72) Inventor: Stephan Schreckenberg, Pulheim-Stommeln (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 762 days.

(21) Appl. No.: 15/738,123

(22) PCT Filed: Jun. 30, 2015

(86) PCT No.: PCT/EP2015/064827
§ 371 (c)(1),
(2) Date: Dec. 20, 2017

(87) PCT Pub. No.: WO2017/000990
PCT Pub. Date: Jan. 5, 2017

(65) Prior Publication Data

US 2018/0187698 A1 Jul. 5, 2018

(51) Int. Cl.
*F04D 29/62* (2006.01)
*F04D 13/06* (2006.01)
(Continued)

(52) U.S. Cl.
CPC ..... *F04D 29/628* (2013.01); *F01P 5/12* (2013.01); *F04D 13/06* (2013.01); *F04D 29/406* (2013.01);
(Continued)

(58) Field of Classification Search
CPC .... F04D 29/628; F04D 29/669; F04D 29/086; F04D 13/02; F04D 29/005; F04D 29/007;
(Continued)

(56) References Cited

U.S. PATENT DOCUMENTS 3,966,363 A * 6/1976 Rowley ..... F04D 13/06 417/423.11
4,911,609 A * 3/1990 Anderson ..... F04D 29/126 248/674
(Continued)

FOREIGN PATENT DOCUMENTS

CN 2742156 Y 11/2005
CN 102242717 A 11/2011
(Continued)

*Primary Examiner* — Essama Omgba
*Assistant Examiner* — Timothy P Solak
(74) *Attorney, Agent, or Firm* — Norman B. Thot

(57) ABSTRACT

An electric motor-vehicle coolant pump includes a pump housing with a flow housing part and a separate motor housing part, a spiral flow channel with an axial inlet and a tangential outlet, a rotatably supported fluid-conveying element, an electric drive motor which drives the rotatably supported fluid-conveying element, and a mounting structure which mounts the pump housing to a vehicle structure. The mounting structure is only arranged on the flow housing part. The flow housing part at least partially surrounds the spiral flow channel and at least partially surrounds the rotatably supported fluid-conveying element. The separate motor housing part surrounds the electric drive motor.

11 Claims, 2 Drawing Sheets

(51) Int. Cl.

| | |
|---|---|
| ***F04D 29/42*** | (2006.01) |
| ***F01P 5/12*** | (2006.01) |
| ***F04D 29/66*** | (2006.01) |
| ***F04D 29/08*** | (2006.01) |
| ***F04D 29/60*** | (2006.01) |
| ***F04D 29/40*** | (2006.01) |
| *F04D 29/00* | (2006.01) |

(52) U.S. Cl.
CPC ..... *F04D 29/426* (2013.01); *F04D 29/605* (2013.01); *F04D 29/669* (2013.01); *F01P 2005/125* (2013.01); *F04D 29/007* (2013.01); *F04D 29/086* (2013.01)

(58) Field of Classification Search
CPC ..... F04D 29/165; F04D 29/42; F04D 29/406; F04D 29/60; F04D 29/605; F04D 29/62; F01P 5/12; F01P 2005/125
See application file for complete search history.

(56) References Cited

U.S. PATENT DOCUMENTS 5,007,806 A * 4/1991 Bellis ..... F02M 37/04 123/509
5,310,310 A * 5/1994 Nakatsukasa ..... F04D 29/605 415/214.1
5,529,462 A * 6/1996 Hawes ..... F04D 29/406 417/360
6,200,108 B1 * 3/2001 Caudill ..... F04D 13/06 165/47
6,497,201 B1 12/2002 Werson
6,499,964 B2 * 12/2002 Staton ..... F04C 11/008 417/310
2002/0015647 A1 * 2/2002 Nakagaki ..... F04D 29/605 417/363
2004/0062664 A1 * 4/2004 Weigold ..... F04D 13/0626 417/357
2004/0255877 A1 12/2004 Ichihara
2013/0309084 A1 * 11/2013 Schreckenberg ..... F04D 29/426 415/213.1
2014/0023526 A1 1/2014 Roby
2014/0161647 A1 * 6/2014 Al-Hasan ..... F01C 21/10 417/410.1

FOREIGN PATENT DOCUMENTS

DE 92 19 022 U1 1/1997
JP 2014-185629 A 10/2014
WO WO 2014/195001 A1 12/2014

* cited by examiner

PUMP HOUSING HAVING A FASTENING STRUCTURE

CROSS REFERENCE TO PRIOR APPLICATIONS

This application is a U.S. National Phase application under 35 U.S.C. § 371 of International Application No. PCT/EP2015/064827, filed on Jun. 30, 2015. The International Application was published in German on Jan. 5, 2017 as WO 2017/000990 A1 under PCT Article 21(2).

FIELD

The present invention relates to an electric motor-vehicle coolant pump comprising a pump housing which has at least a flow housing part and a separate motor housing part, wherein the flow housing part at least partially surrounds a spiral flow channel which has an axial inlet and a tangential outlet, and at least partially surrounds a rotatably supported fluid-conveying element, and wherein the motor housing part surrounds an electric drive motor for driving the fluid-conveying element, wherein the pump housing can be mounted to a vehicle structure via a mounting structure.

BACKGROUND

Such electric motor-vehicle pumps have previously been described and mostly serve to convey a coolant for cooling an internal combustion engine of a vehicle. Due to the commonly used structure, such pumps often comprise a plurality of individual parts, such as, for example, the flow housing part and the motor housing part, which are most often rotationally oriented to each other, are fixed to each other by a fixation device and, in the assembled state, constitute the whole pump housing. The fluidic connection of such a pump to a vehicle is most often effected via separately formed hoses. Supports or mounting structures are generally provided for the mechanical fixing or mounting of the coolant pump to a vehicle structure such as, for example, a vehicle body or an engine block, the supports or mounting structures each being arranged separately or integrally on the individual housing parts of the pump. Damping devices are often provided at the mounting structures to reduce vibrations and noises caused thereby.

Such coolant pumps must typically be designed individually depending on the vehicle model, in particular with respect to the required pump capacity, the given fluidic connections, the mounting structures, as well as the damping device. As the number of given features increases, however, matching the interfaces between the pump and the vehicle becomes more complex, which causes increased effort in particular during manufacture and assembly of the coolant pumps.

SUMMARY

An aspect of the present invention is to provide an electric motor-vehicle coolant pump which provides a design for all vehicle models and which provides a relatively universal possibility of mounting to a vehicle structure.

In an embodiment, the present invention provides an electric motor-vehicle coolant pump which includes a pump housing comprising a flow housing part and a separate motor housing part, a spiral flow channel comprising an axial inlet and a tangential outlet, a rotatably supported fluid-conveying element, an electric drive motor configured to drive the rotatably supported fluid-conveying element, and a mounting structure configured to mount the pump housing to a vehicle structure. The mounting structure is only arranged on the flow housing part. The flow housing part at least partially surrounds the spiral flow channel and at least partially surrounds the rotatably supported fluid-conveying element. The separate motor housing part surrounds the electric drive motor.

BRIEF DESCRIPTION OF THE DRAWINGS

The present invention is described in greater detail below on the basis of embodiments and of the drawings in which.

DETAILED DESCRIPTION

Figure 1:
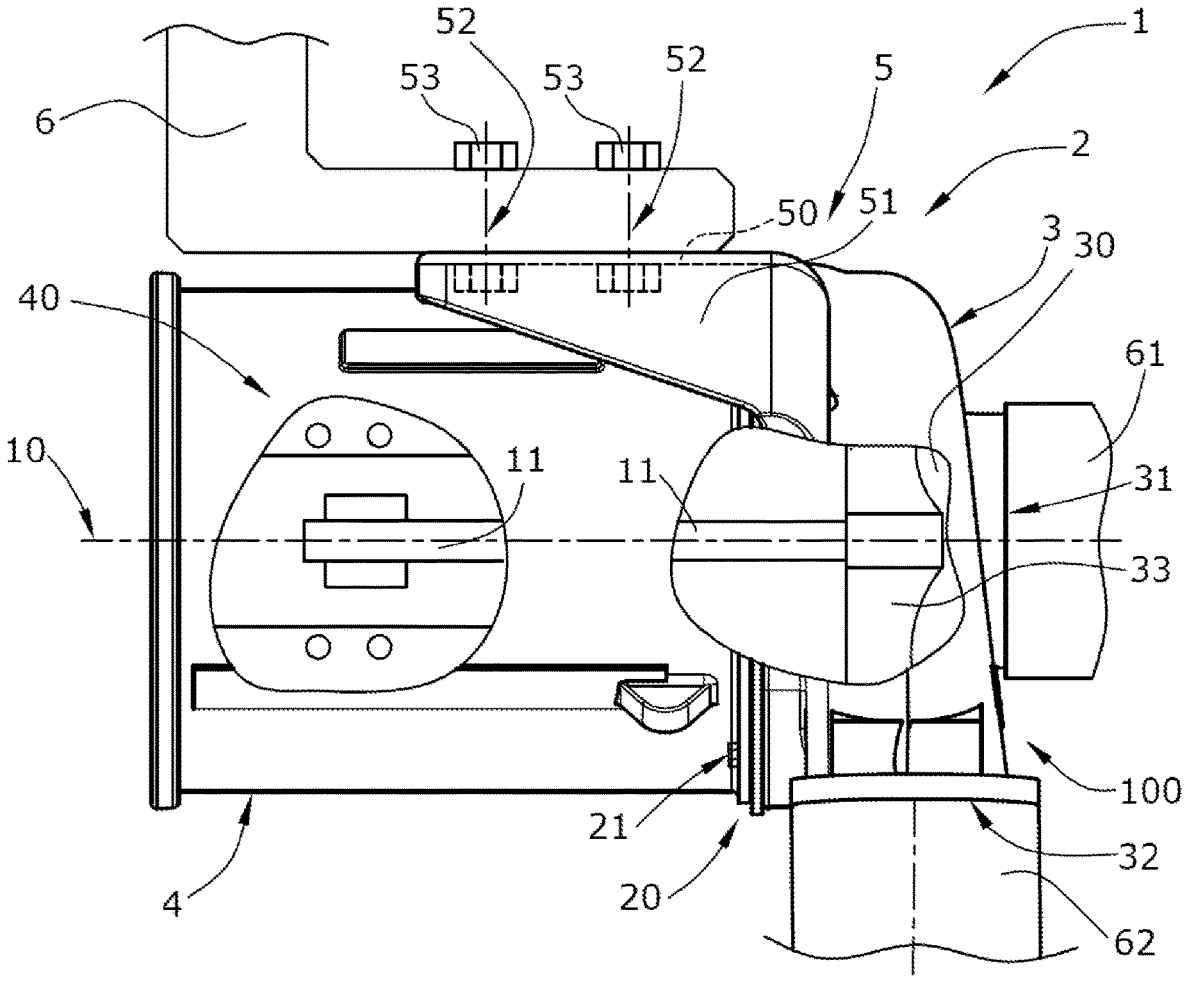
FIG. 1 schematically shows a side view of an assembled electric coolant pump.

According to the present invention, the mounting structure is arranged on the pump side exclusively on the flow housing. The interfaces for the fluidic and mechanical connection of the coolant pump to a vehicle structure can thus be restricted to the flow housing part alone, thereby simplifying the design of the coolant pump. In particular the design and the specification of the interfaces between the pump and the vehicle can be restricted to only the design of the flow housing part. In contrast thereto, depending on the vehicle model and the requirements connected therewith, for example, with respect to a model variant and/or the pump capacity, the motor housing part can have various structural forms and sizes and can be manufactured entirely independent of the interfaces and connection conditions of the pump existing in the vehicle. The manufacture and assembly of the coolant pump can thereby be significantly simplified and can therefore be relatively economic.

The mounting structure may basically be a separate part, such as a clamp or a support arm, wherein the mounting structure may be adapted individually to the shape of the flow housing part. The mounting structure is advantageously formed integrally with the flow housing part. The number of components can thus be reduced and the coolant pump can be fixed on the vehicle structure in a relatively simple manner.

The mounting structure is advantageously arranged in parallel with the rotation axis in the longitudinal direction. A particularly stable and relatively secure fixation of the coolant pump to the vehicle structure is thus made possible. The pump thus also has a relatively compact structure.

In an embodiment of the present invention, the mounting structure can, for example, have a support arm projecting outward from the flow housing part. This allows for a reduction of the number of components and for a relatively simple fixation of the coolant pump on the vehicle structure. The support arm advantageously comprises (in particular at its distal end) an opening or bore through which a screw, a rivet, a bolt or another mounting element may extend to mount the support arm to the vehicle structure. The support arm may also comprise an outward protruding centering pin for aligning the support arm with respect to the vehicle structure.

The support arm may be designed as a flange and may comprise at least one reinforcement rib. The reinforcement rib may in particular be formed on the flange in the longitudinal direction of the flange. The support arm thus has a particularly high stability.

The mounting structure can, for example, comprise at least three mounting points for a spot mounting of the pump housing on the vehicle structure. A mounting point can, for example, be an opening through which a screw extends for mounting. Exactly three such mounting points can, for example, be provided. A relatively stable and secure fixation of the coolant pump on the vehicle structure can thereby be provided.

The mounting points can, for example, be arranged in a plane parallel to the rotation axis. A common contact plane is thereby formed via which the mounting structure can abut against and be fixed on a contact surface of the vehicle structure in a relatively simple manner.

The mounting points can, for example, be arranged in a right triangle with respect to each other in the plane. This allows for a particularly stable fixation of the pump on the vehicle structure, wherein the pump is in particular fixed against tilting and/or turning.

In an embodiment of the present invention, the mounting structure can, for example, be fixed on the vehicle structure using a frictional and/or a positive connection. The mounting structure can thereby be fixed on the vehicle structure, in particular in a releasable manner, using, for example, a screw. This is advantageous in particular in case of a repair or a replacement of the pump.

The mounting structure advantageously comprises at least one vibration damper, for example, at a mounting point. The vibration damper may in particular be suited to dampen undesirable vibrations of the coolant pump, and to thereby prevent a loosening of the pump's mounting on the vehicle structure, and to dampen noise.

The vibration damper can, for example, be designed as an elastomer ring resting in an opening, for example, a mounting point, on the mounting structure. The elastomer ring, for example, a rubber ring, may be placed or inserted in an opening or recess provided in the mounting structure for this purpose. This provides a relatively reliable damping of the coolant pump and simplifies the assembly of the coolant pump.

The flow housing part can, for example, comprise a centering structure for aligning the motor housing part with respect to the flow housing part. The centering structure may be a shoulder or a recess into which a pin can, for example, be inserted. A shoulder is advantageously formed on the flow housing part where the motor housing part can be inserted in only one defined rotational orientation. A pump rotor carrying the fluid-conveying element may also be inserted in a shoulder of the flow housing part and may be rotatably supported thereon for supporting purposes. The coolant pump may thereby be of a relatively compact structure.

The flow housing part can, for example, comprise an axial and/or radial gap sealing surface towards the fluid-conveying element. Fluid conveying can therefore occur in a relatively loss-free manner so that the efficiency of the coolant pump can be augmented.

The present invention will be explained below in greater detail under reference to the drawings.

FIG. 1 shows an electric motor-vehicle coolant pump 1 in the mounted state 100. Specifically, the coolant pump 1 is mechanically fixed to a purely schematically illustrated vehicle structure 6 via a mounting structure 5.

The coolant pump 1 comprises a pump housing 2 which in the present instance comprises a flow housing part 3 and a separate motor housing part 4. A spiral-shaped flow channel 30 and a rotatable fluid-conveying element 33 situated therein are arranged inside the flow housing part 3, the fluid-conveying element 33 being shown in FIG. 1 in a cutaway view. The flow channel 30 has an axial inlet 31 and a tangential outlet 32. The fluid-conveying element 33 is supported on a drive shaft 11 that extends into the motor housing part 4. Inside the motor housing part 4, a drive motor 40 is arranged for driving the fluid conveying element 33 via the drive shaft 11, which is also shown in a cutaway view in FIG. 1.

At a connecting site 20, the flow housing part 3 and the motor housing part 4 are aligned with each other and are fixed to each other by a plurality of screw connections 21. The screw connection 21 is designed to be stable enough for the flow housing part 3 to support the motor housing part 4 and the components arranged therein without further support.

A fluidic connection between the coolant pump 1 and the vehicle (which is not shown in detail in the drawings) is established via a supply channel 61 (which is also not shown in detail in the drawings) at the inlet 31 and a discharge channel 62 at the outlet 32 of the (pump-side) flow channel 30.

Figure 2:
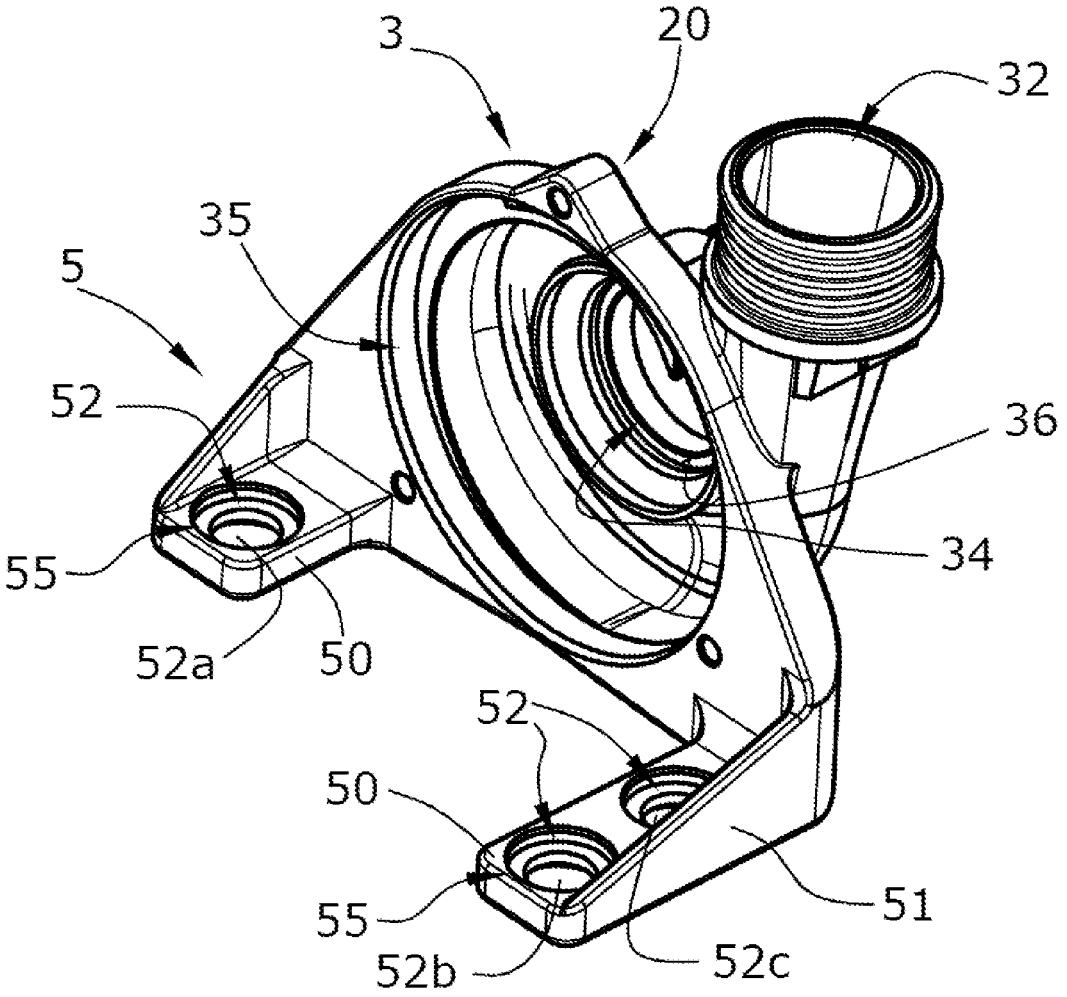
FIG. 2 schematically shows a perspective view of a flow housing part with a mounting structure.

A mechanical fixation of the coolant pump 1 to the vehicle structure 6 is effected exclusively via the mounting structure 5, which in the present case, as can in particular be seen in FIG. 2, is formed by two support arms 50. Each support arm 50 is designed as a flange with a reinforcement rib 51 in the present case. Each support arm 50 is formed integrally with the flow housing part 3 and projects outward from the flow housing part 3. Each support arm 50 also has a plurality of bores 52 at a distal end through which a respective screw 53 extends for the fixation of the flow housing part 3 on the vehicle structure 6. The entire coolant pump 1 can be fixed on the vehicle structure 6 via this arrangement.

FIG. 2 shows the flow housing part 2 in a non-mounted state. As can be seen particularly clearly in FIG. 2, the mounting structure 5 is formed by two support arms 50 arranged at the flow housing part 3 and projecting therefrom.

On a side facing the drive motor 40, the flow housing part 3 has a centering structure 35 for aligning the motor housing part 4 with respect to the flow housing part 3. In the present case, the centering structure 35 is in particular a shoulder arranged coaxially with respect to the rotation axis 10. A seal (which is not shown in detail in the drawings) is also provided at the centering structure 35 via which the interior of the pump housing 2 can be sealed from the surroundings.

At a further shoulder or a contact surface 36 of a side also facing the drive motor 40, the flow housing part 3 has an axial and radial gap sealing surface 34 at which the fluid-conveying element 33 can be supported. Fluid can thus be conveyed in a relatively loss-free manner so that the efficiency of the coolant pump 1 can be augmented.

It should be clear that the present invention is not restricted to the embodiments described herein; reference should be had to the appended claims.

LIST OF REFERENCE NUMERALS

1 motor-vehicle coolant pump
10 rotational axis
11 drive shaft
2 pump housing
20 housing connection, connecting site
21 screw connection
3 flow housing part
30 flow channel
31 inlet
32 outlet
33 fluid conveying element

34 gap sealing surface
35 centering structure
36 contact surface
4 motor housing part
40 drive motor
5 mounting structure
50 support arm, flange
51 reinforcement rib
52 opening, bore
52*a* mounting point, mounting element
52*b* mounting point, mounting element
52*c* mounting point, mounting element
53 screw
55 vibration damper
6 vehicle structure
61 supply channel
62 discharge channel
100 mounted state

What is claimed is:

1. A motor-vehicle electric coolant pump comprising:

a pump housing comprising a flow housing part and a separate motor housing part;

a spiral flow channel comprising an axial inlet and a tangential outlet;

a rotatably supported fluid-conveying element;

an electric drive motor configured to drive the rotatably supported fluid-conveying element; and a mounting structure configured to mount the pump housing to a vehicle structure, the mounting structure only being arranged on the flow housing part, wherein, the flow housing part at least partially surrounds the spiral flow channel and at least partially surrounds the rotatably supported fluid-conveying element, the separate motor housing part surrounds the electric drive motor, the mounting structure is formed integrally with the flow housing part, the rotatably supported fluid-conveying element comprises a rotation axis, the mounting structure is arranged in parallel with the rotation axis in a longitudinal direction, and a mechanical fixation of the electric coolant pump to the vehicle structure is effected exclusively via the mounting structure without a further support.

2. The motor-vehicle electric coolant pump as recited in claim 1, wherein the mounting structure comprises a support arm which projects from the flow housing part.

3. The motor-vehicle electric coolant pump as recited in claim 2, wherein the support arm is a flange comprising at least one reinforcement rib.

4. The motor-vehicle electric coolant pump as recited in claim 1, wherein the mounting structure comprises at least three mounting points which are configured to provide a spot mounting on the vehicle structure.

5. The motor-vehicle electric coolant pump as recited in claim 4, wherein the at least three mounting points are arranged in a plane which is parallel to the rotation axis.

6. The motor-vehicle electric coolant pump as recited in claim 5, wherein the at least three mounting points are arranged in a plane in a right triangle with respect to each other.

7. The motor-vehicle electric coolant pump as recited in claim 1, wherein the mounting structure is fixed on the vehicle structure using at least one of a frictional connection and a positive connection.

8. The motor-vehicle electric coolant pump as recited in claim 1, wherein the mounting structure comprises at least one vibration damper.

9. The motor-vehicle electric coolant pump as recited in claim 8, wherein, the mounting structure further comprises an opening, and the vibration damper is an elastomer ring which is configured to rest in the opening on the mounting structure.

10. The motor-vehicle electric coolant pump as recited in claim 1, wherein the flow housing part comprises a centering structure configured to align the motor housing part with respect to the flow housing part.

11. The motor-vehicle electric coolant pump as recited in claim 1, wherein the flow housing part comprises at least one of an axial gap sealing surface and a radial gap sealing surface at a contact surface to the rotatably supported fluid-conveying element.

* * * * *